US005893473A

United States Patent [19]

Morris, Sr.

[11] Patent Number: 5,893,473

[45] Date of Patent: Apr. 13, 1999

[54] CHILD-RESISTANT CLOSURE

[76] Inventor: Glenn H. Morris, Sr., 1191 Cumberland Rd., Chattanooga, Tenn. 37419

[ * ] Notice: This patent is subject to a terminal disclaimer.

[21] Appl. No.: 08/868,729

[22] Filed: Jun. 4, 1997

[51] Int. Cl.[6] ..... B65D 55/02

[52] U.S. Cl. ..... 215/220; 215/219

[58] Field of Search ..... 215/219, 220, 215/221, 217

[56] References Cited

U.S. PATENT DOCUMENTS

| | | | |
|---|---|---|---|
| 2,847,139 | 8/1958 | Christiansson et al. . | |
| 3,394,829 | 7/1968 | Peterson . | |
| 4,832,218 | 5/1989 | Gibilisco | 215/220 |
| 4,998,632 | 3/1991 | Morris, Sr. . | |
| 5,615,787 | 4/1997 | Morris, Sr. . | |

FOREIGN PATENT DOCUMENTS

| | | | |
|---|---|---|---|
| 0324079 | 7/1989 | European Pat. Off. | 215/217 |
| 0528561 | 2/1993 | European Pat. Off. . | |
| 2260534 | 4/1993 | United Kingdom . | |

*Primary Examiner*—Stephen K. Cronin
*Attorney, Agent, or Firm*—Birch, Stewart, Kolasch & Birch, LLP

[57] ABSTRACT

A child-resistant closure includes an inner cap threadable mountable to a container, and an outer cap attached to the inner cap and freely rotatable relative to the inner cap during a child-resistant mode, and interconnected with the inner cap for removal of the closure from the container when the closure is in a non-child-resistant mode. An intermediate member is rotatably mounted between the inner cap and the outer cap and movable between a first position prohibiting the inner and outer caps from being interconnected for removal from the container and a second position permitting the manipulation of the outer cap relative to the inner cap for interconnecting the inner and outer caps for removal of the closure from the container. The intermediate member includes a spring which axially biases the outer cap away from the inner cape and which additionally torsionally biases the outer cap to rotate the outer cap relative to the inner cap when the outer cap is released from interconnection with the inner cap to automatically return the closure to the child-resistant mode. While the closure is in the child-resistant mode, the outer cap is freely rotatable in a loosening direction of the closure. However, rotation of the outer cap in a tightening direction only serves to further tighten the inner cap on the container.

23 Claims, 5 Drawing Sheets

CHILD-RESISTANT CLOSURE

BACKGROUND OF THE INVENTION

1. Field of the Invention

The present invention relates to a child-resistant closure, and more specifically, to a closure having an inner cap and an outer cap which must be manipulated in a specific manner in order to remove the closure from a container to which the closure is attached.

2. Description of the Background Art

Various child-resistant closures are known in the art. For example, Applicant's U.S. Pat. No. 5,615,787, the entire contents of which are hereby incorporated by references, discloses a condition indicating child-resistant closure assembly including an inner cap, an outer cap, and a bridge member located therebetween. The inner cap includes a top wall having a post extending therefrom which is extendable through an aperture in the top wall of the outer cap. The bridge member is positioned in a recess of the inner cap top wall and is freely rotatable on the post between a first position prohibiting the inner and outer caps from being interconnected for removal from the container, and a second position permitting the manipulation of the outer cap relative to the inner cap for interconnecting the inner and outer caps for removal of the closure from the container. The outer cap includes a plurality of flexible fingers extending from the inner surface of the top wall which are adapted to engage the bridge member for moving the bridge member alternately between these two positions Stop members are arranged on the top wall of the inner cap for limiting rotary movement of the bridge member between the two positions A coil spring is mounted in coaxial relationship with the post and is positioned between the bridge member and the inner surface of the top wall of the outer cap for biasing the outer cap outwardly relative to the inner cap.

Further, Applicant's U.S. Pat. No. 4,998,632, the entire contents of which are hereby incorporated by reference, discloses a child-resistant cap which includes an inner cap threadably mountable to a container, and an outer cap which includes a pair of spring legs which engage ramps extending upwardly from the inner cap. The free ends of the spring legs slide up the back sides of the ramps and over the lip portion of the ramp to hold the outer cap upwardly in spaced relation to the inner cap to maintain the closure in a child-resistant mode as the outer cap is continually rotated counter-clockwise. To interlock the inner and outer caps, the outer cap is rotated clockwise relative to the inner cap until the free ends of the spring legs engage the front sides of the ramps, thus stopping further clockwise rotation of the outer cap. At this position, a pair of lugs on the outer cap become aligned with respective inclined slots on the inner cap such that the outer cap may be moved axially toward the inner cap, and thereafter the outer cap is rotated counter-clockwise to thereby move the lugs into abutment with closed ends of the slots, whereby the inner and outer caps become interlocked in a non-child-resistant position and further counter-clockwise rotation allows the inner cap to be removed or unscrewed from the bottle or container.

While these arrangements are useful for providing a child-resistant closure, there exists a need for a closure which is extremely reliable and easy to manufacture, and having a minimum number of components to assemble. Further, there exists a need in the industry for a closure which automatically returns the closure to a child-resistant mode when the outer cap is released

SUMMARY OF THE INVENTION

Accordingly, it is an object of the present invention to provide a child-resistant closure which is simple and inexpensive to manufacturer and assemble.

It is a further object of the present invention to provide a child-resistant closure which is easy for an adult to open without requiring the closure to be viewed by the user.

Yet another object of the present invention is to provide a child-resistant closure which may be opened with the palm of the hand and openable by consumers having arthritic hands.

Yet still another object of the present invention is to provide a child-resistant closure which automatically returns the closure to a child-resistant mode after the consumer tightens the cap.

These and other object of the present invention are fulfilled by a child-resistant closure having an inner cap adapted to be threadably mounted on a container, and an outer cap mounted on the inner cap and freely rotatable in a first direction relative to the inner cap during a child-resistant mode of the closure but interconnectable with the inner cap for removal of the closure from the container during a non-child-resistant mode of the closure. The child-resistant closure includes an intermediate member located between the inner cap and the outer cap. The intermediate member is freely rotatable in the first direction between a first position prohibiting the inner and outer caps from being interconnected for removal from the container and a second position permitting the manipulation of the outer cap relative to the inner cap for interconnecting the inner and outer cap for removal of the closure from the container.

The outer cap includes a top wall having a pair of lug members extending therefrom. The inner cap includes a pair of raised arcuate wall members separated by a pair of diametrically opposed axially extending slots. The lug members are movable into the respective slots when the closure is in the non-child-resistant mode such that rotation of the outer cap produces rotation of the inner cap. When the closure is in the child-resistant mode, the lugs ride along an upper peripheral surface of the raised arcuate wall members.

A spring is integrally formed with the intermediate member and located between the inner cap and the outer cap for axially biasing the outer cap away from the inner cap. In addition, the spring torsionally biases the outer cap when the outer cap is released from interconnection with the inner cap to automatically return the closure to the child-resistant mode. Thus, the combined action of the spring causes the pair of lugs to move axially out of the respective slots, and then to rotate such that the lugs move to a position over the upper peripheral surfaces of the raised arcuate wall members.

The child-resistant closure includes a post attached to the inner cap and which extends through the outer cap when the child-resistant closure is in a non-child-resistant mode, to thereby provide a visual indication that the closure is not in a child-resistant mode, thereby promoting additional safety of the child-resistant closure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and, thus, are not limitative of the present invention, and wherein.

DETAILED DESCRIPTION OF THE PREFERRED EMBODIMENTS

Figure 1:
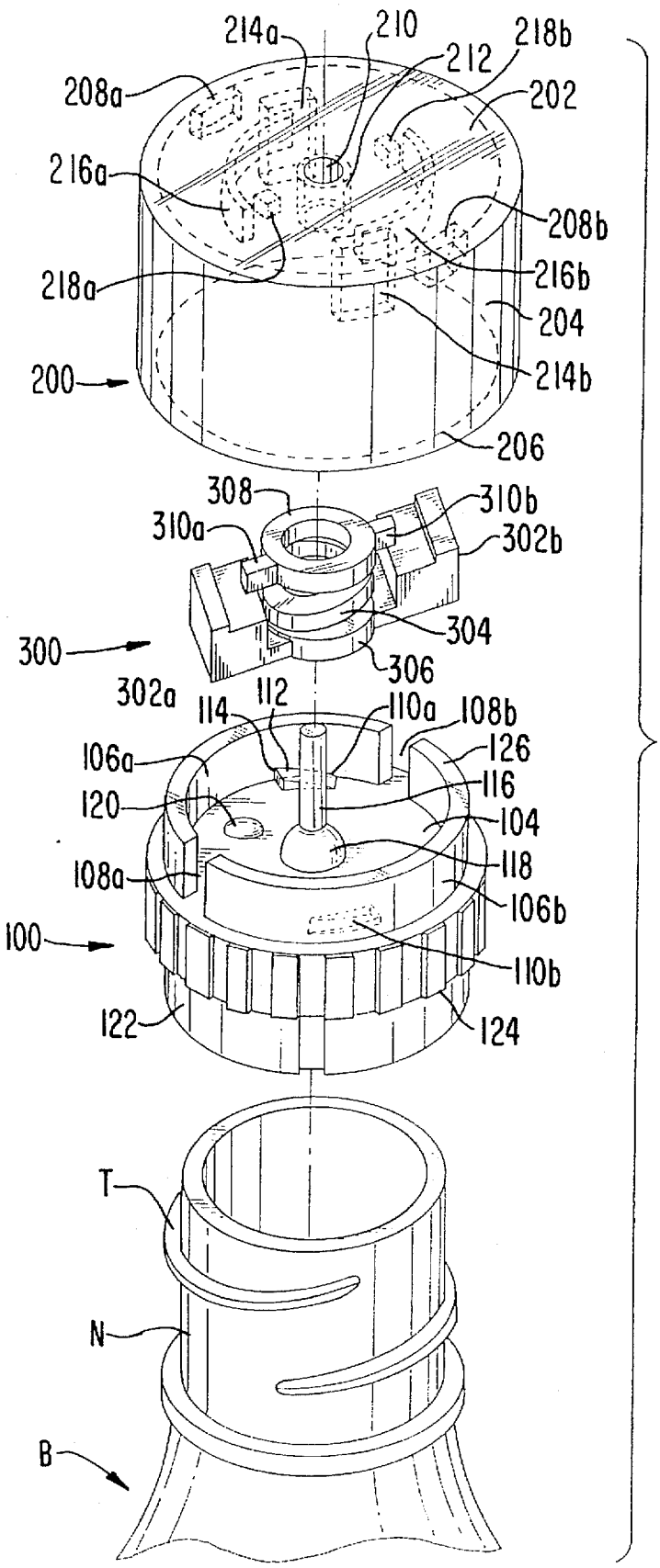
FIG. 1 is an exploded perspective view of the closure.

Referring in detail to the drawings, and with particular reference to FIG. 1, a child-resistant closure of the present invention is shown. The child-resistant closure comprises an inner cap 100 adapted to be threadably mounted onto the neck N of a medicine bottle B by threads T provided on the neck N of the bottle B. The inner cap 100 is provided with threads 102 a shown in FIG. 3, which matingly engage with the threads T of the bottle B. The inner cap includes a top wall 104 having a pair of arcuate walls 106*a*, 106*b* extending upwardly therefrom. Arranged between the arcuate walls 106*a*, 106*b* are a pair of diametrically disposed axially extending slots 108*a*, 108*b*.

The top wall 104 of the inner cap 100 includes a pair of one-way ramp members 110*a*, 110*b* which are spaced radially inwardly of the arcuate walls 106. The one-way ramp members 110*a*, 110*b* include an inclined portion 112 and an abutment portion 114. A post 116 extends upwardly from the center of the top wall 104 of the inner cap 100, having an enlarged portion 118 located at the lower end of the post 116.

A protrusion 120 is located on the top wall 104 and extends just slightly above the upper surface of the top wall 104. The inner cap 100 further includes a skirt portion 122 depending downwardly from the top wall 104. The threads 102 are located on the interior surface of the skirt portion 122. A shoulder 124 extends circumferentially around the outer surface of the skirt portion 122.

An outer cap 200 is provided with a top wall 202 and a skirt portion 204 extending downwardly from the top wall 202. An inwardly extending annular bead 206 is arranged circumferentially around an inner surface of the lower end of the skirt portion 204. The outer cap 200 is placed over the inner cap 100 such that the skirt portion 204 of the outer cap 200 surrounds most of the skirt portion 122 of the inner cap 100. When the outer cap 200 is assembled with the inner cap 100, the annular bead 206 is engaged below the shoulder 124 to captivate the inner cap 100 inside the outer cap 200.

Although the annular bead 206 is shown as a continuous element in the figures, it should be understood that the annular bead 204 may comprise a plurality of segmented and discontinuous bead portions extending around the inner circumference of the skirt portion 204 for engaging the shoulder 124 of the inner cap 100. Alternatively, the inner cap 100 may be provided with an outwardly extending annular bead which engages a corresponding groove in the inner circumference of the skirt portion 204 of the outer cap in order to captivate the inner cap 100 in the outer cap 200.

Extending downwardly from the interior surface of the top wall 202 of the outer cap 200 are arranged a pair diametrically opposed lugs 208*a*, 208*b*. The lugs 208*a*, 208*b* are also connected to the inner surface of the skirt portion 204 for added strength. The lugs 208*a*, 208*b* are engagable with upper peripheral surfaces 126 of the arcuate walls 106*a*, 106*b* when in the child-resistant mode, wherein the outer cap 200 is freely rotatable on the inner cap 100. The lugs 208*a*, 208*b* are movable into the axially extending slots 108*a*, 108*b* of the inner cap 100 when in the non-child-resistant mode such that rotation of the outer cap 200 produces a corresponding rotation of the inner cap 100, to thereby tighten or loosen the inner cap 100 on the bottle B.

The top wall 202 of the outer cap 200 may include an aperture 210 located centrally therein for allowing the upper portion of the post 116 to pass therethrough when the outer cap 200 is manipulated into the non-child-resistant mode, thereby providing a visible indication that the closure is not in a child-resistant mode. A support member 212 surrounds the aperture 210 and extends downwardly from an inner surface of the top wall 202.

The top wall 202 of the outer cap 200 further includes a pair of diametrically opposed leg members 214*a*, 214*b* depending downwardly from the inner surface of the top wall 202. Proceeding radially inwardly from the leg members 214*a*, 214*b* are arranged a pair of diametrically opposed arcuate wall members 216*a*, 216*b*. Further proceeding radially inwardly from the arcuate wall members 216*a*, 216*b* are arranged a pair of diametrically opposed stop members 218*a*, 218*b*.

An intermediate member 300 is arranged between the inner cap 100 and the outer cap 200. The intermediate member 300 includes a pair of radially extending arm members 302*a*, 302*b*. Located centrally between the arm member 302*a*, 302*b* is a helical coil spring 304. The spring 304 includes a lower ring member 306 which is connected to the respective arm members 302*a*, 302*b*, and which extends around and is supported by the enlarged portion 118 of the post 116 when the intermediate member 300 is placed on the inner cap 100. The spring 304 further includes an upper ring member 308 which is supported by the support member 212 of the outer cap 200 when the outer cap 200 is assembled with the inner cap 100. The upper ring member 308 includes a pair of radially extending diametrically opposed ears 310*a*, 310*b*. The ears 310*a*, 310*b* extend radially along a line essentially parallel to a radial line extending through the respective arm members 302*a*, 302*b*.

The above recited elements which comprise the intermediate member 300 are formed as a one-piece integral member, preferably by injection molding using a nylon material. The inner cap 100 and the outer cap 200 are further preferably formed by injection molding using polypropylene. This combination of materials results in a closure which is lightweight, durable, and recyclable when its useful life has ended. Further, the selection of nylon for use in mating the spring results in a spring which will return to its initial position after being deflected without introducing memory effects associated with other materials wherein the spring, if left in a compressed position, will thereafter retain that compressed position due to the above mentioned memory effect.

The operation of the child-resistant closure will now be explained, with particular reference to FIGS. 2–8. Except for the protrusion 120 on the top wall of the inner cap 100, many of the elements which comprise the child-resistant closure are symmetrically arranged in pairs in a diametrically opposed manner. Therefore, the following discussion will generally describe the operation of one element from each of the pairs of elements. However, it should be understood that the remaining elements of the pairs operate in the same manner.

Figure 2:
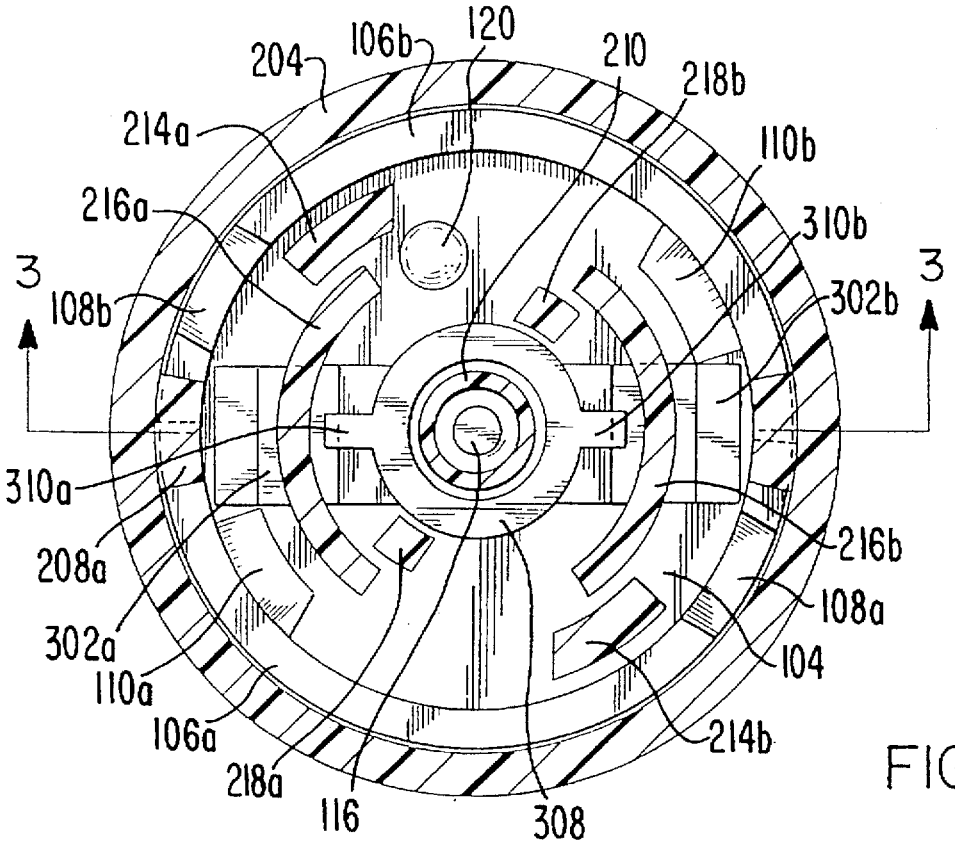
FIG. 2 is a sectional plan view taken through the upper portion of the outer cap, showing the cap in a child-resistant mode with the lug members out of alignment with the axially extending slots.
Figure 3:
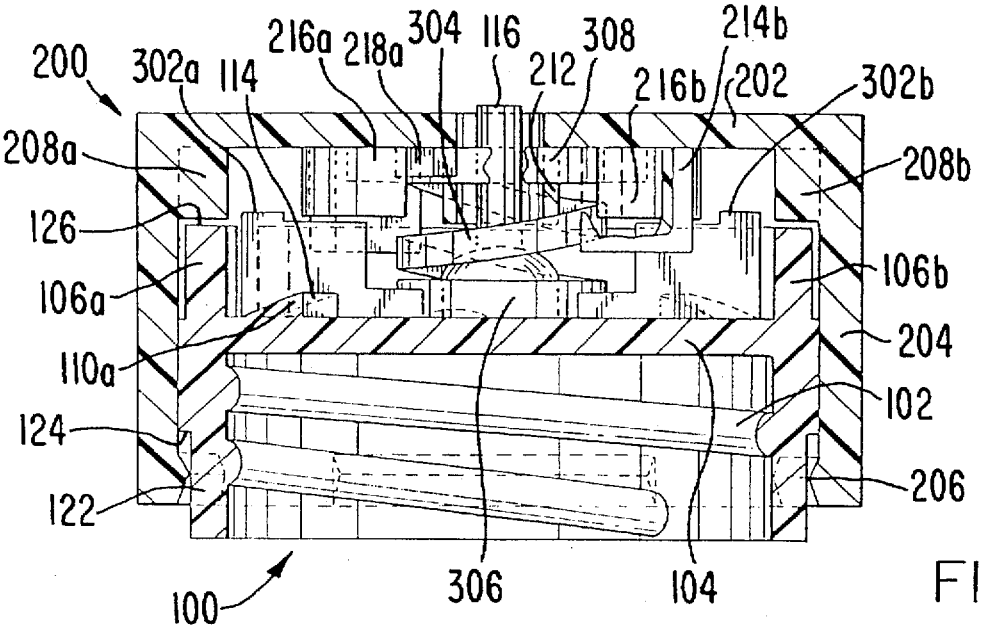
FIG. 3 is a side sectional view taken along line 3—3 of FIG. 2 which extends radially inwardly until reaching the inner peripheral edge of the inner cap, and which thereafter follows the contour of the inner cap.

As shown in FIGS. 2 and 3, the child-resistant closure is in a child-resistant mode. The lug 208*a* is not aligned with either of the axially extending slots 108*a*, 108*b*. Instead, the lug 208 is positioned above the arcuate wall 106*a* to ride along the upper peripheral surface of the arcuate wall 106*a*. At this time, it can also been seen that the arcuate wall member 216*a* of the outer cap 200 is located above the arm members 302*a* of the intermediate member 300.

When either the lug 208*a* is not aligned with one of the slots 108*a*, 108*b*, or the arcuate wall member 216*a* is located above one of the arm members 302*a*, 302*b* of the intermediate member 300, it is not possible to axially depress the outer cap 200 with respect to the inner cap 100 due to interference between these respective elements. This is more clearly shown in FIG. 3.

Rotation of the outer cap 200 produces a corresponding rotation of the lug 208*a* , the leg member 214*a*, the arcuate wall member 216*a*, and the stop member 218*a*in the direction of rotation.

Looking at FIG. 2, it will be seen that counterclockwise rotation of the outer cap 200 would cause the leg member 214*a* to engage the side wall of the arm member 302*a*, causing the intermediate member 300 to begin rotating counterclockwise with further counterclockwise movement of the outer cap 200. As the intermediate member 300 rotates counterclockwise, the arm member 302*a* begins traversing the inclined portion 112 of the one-way ramp member 110*a*. As the arm member 302*a* slides upwardly along the one-way ramp member 110*a*, the spring 304 compresses slightly. Further counterclockwise rotation of the outer cap 200 will cause the arm member 302*a* to completely pass over the one-way ramp member 110*a* and proceed toward the inclined portion 112 of the other one-way ramp member 110*b*. Thus, it can be seem that the outer cap 200 may continually rotate counterclockwise without producing any corresponding counterclockwise rotation of the inner cap to unintentionally unthread the inner cap 100 from the bottle.

Looking further at FIGS. 2 and 3, operation of the outer cap 200 in a clockwise rotation will be described. As the outer cap 200 is rotated clockwise by approximately 30°, the lug 208*a* will be aligned above the slot 108*b*. However, the outer cap 200 is prevented from being actually depressed to engage the lug 208*a* in the slot 108*a* due to the position of the arcuate wall member 216*a* of the outer cap 200 above the arm member 302*a* of the intermediate member 300. Thus, the child-resistant closure is prevented from inadvertently being placed in the non-child-resistant mode.

Figure 4:
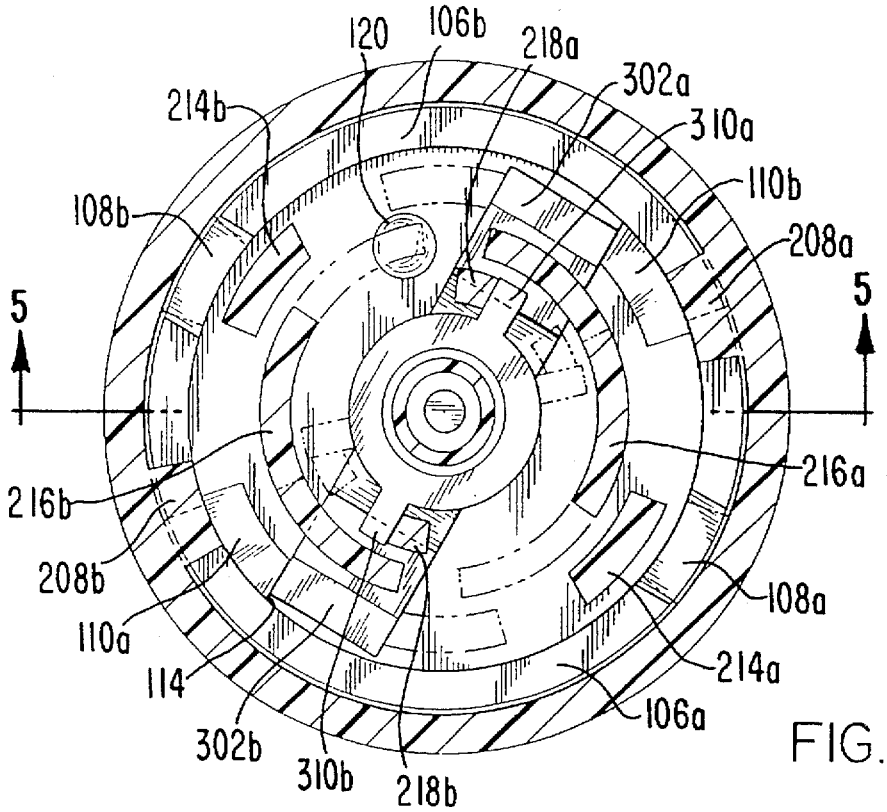
FIG. 4 is a sectional plan view showing the outer cap rotated approximately 160° clockwise from the position shown in FIG. 2.
Figure 5:
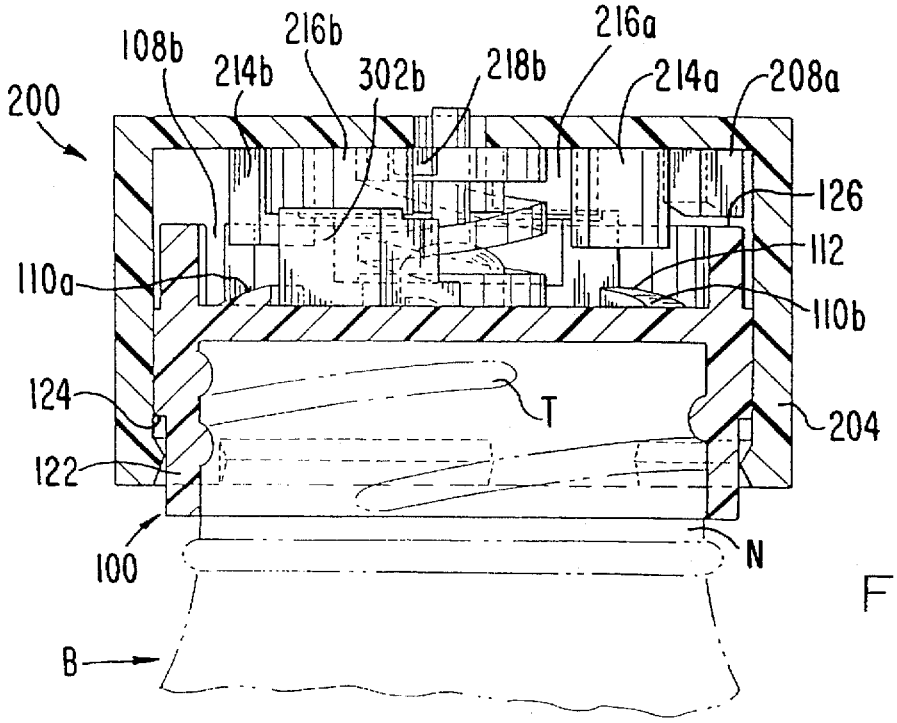
FIG. 5 is a side sectional view taken along line 5—5 of FIG. 4 showing the respective elements.

Further rotation of the outer cap 200 in a clockwise direction causes the stop member 218*a* to engage the ear 310*a* located on the upper ring member 308 of the intermediate member 300. Thus, further clockwise rotation of the outer cap 200 causes the intermediate member 300 to rotate clockwise with the outer cap 200 due to the abutment of the stop member 218*a* against the ear 310*a*. Further continued clockwise rotation of the outer cap 200, and the subsequent clockwise rotation of the intermediate member 300 results in the respective elements achieving an orientation which is shown in FIGS. 4 and 5. The outer cap 200 in FIG. 4 has been rotated clockwise approximately 160° from the orientation shown in FIG. 2.

As shown in FIG. 4, the clockwise rotation of the outer cap 200 has correspondingly rotated the intermediate member 300 clockwise such that the arm member 302*a* has become engaged against the abutment portion 114 of the one-way ramp member 110*b*. Thus, the arm member 302*a* of the intermediate member 300 is prevented from further clockwise rotation as the outer cap 200 may further be rotate clockwise. Further rotation of the outer cap 200 in a clockwise direction by approximately 50° results in the elements assuming an orientation shown in phantom lines in FIGS. 4 and in solid lines in FIGS. 6 and 7. This continued clockwise rotation of the outer cap 200 causes the upper ring member 308 of the spring 304 to rotate clockwise, while the lower ring member 306 remains stationary. The upper ring member 308 is moved clockwise due to the abutment of the slot member 218*a* against the ear 310*a* extending outwardly from the upper ring member 308. This produces a corresponding torsional force in the coil spring 304. Thus, if the outer cap is released by the user from the position shown in FIG. 6,the stored energy in the coiled spring 304 would tend to rotate the outer cap 200 counter-clockwise until the outer cap assumes an orientation shown in FIG. 4 wherein the spring 304 is no longer torsionally compressed The continued clockwise rotation of the outer cap 200 occurs until the leg member 214*a* engages and abuts against the arm member 302*b* of the intermediate member 300, which is constrained from clockwise rotation due to abutment of the arm member 302*b* against the abutment portion 114 of the one-way ramp member 110*a*. Further clockwise rotation of the outer cap 200 thus serves only to further tighten the inner cap 100 on the bottle B.

Figure 6:
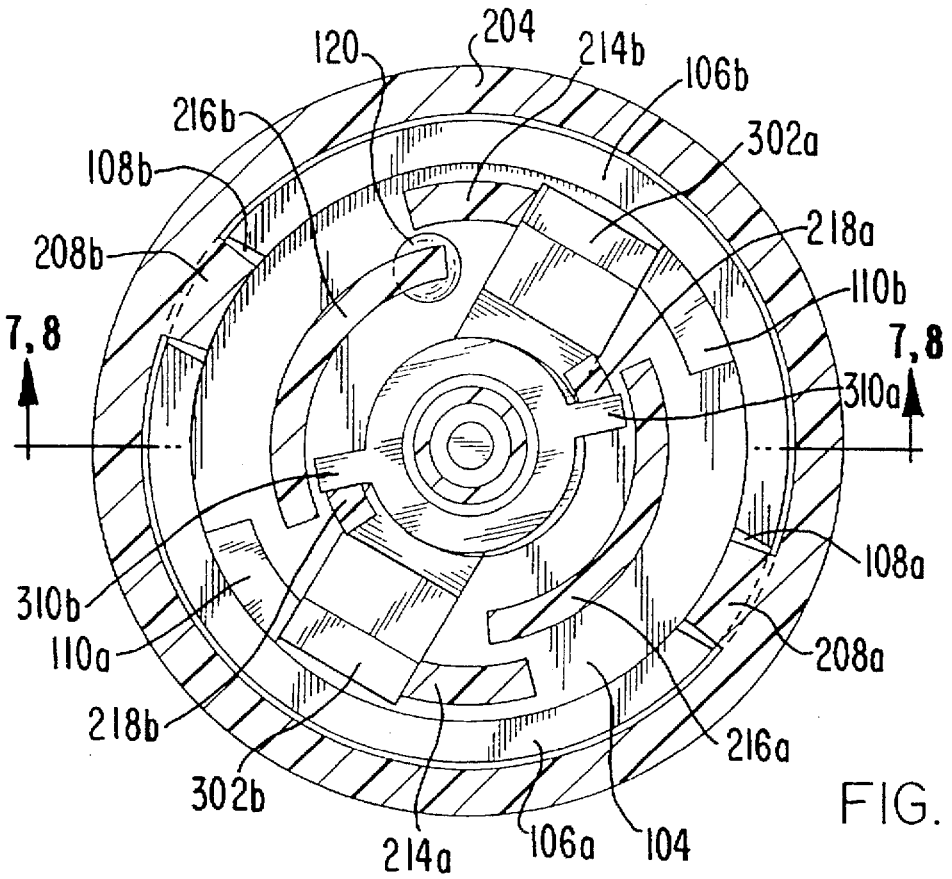
FIG. 6 is a sectional plan view showing the outer cap further rotated clockwise approximately 50° from the position shown in FIG. 4, with the lugs aligned with the slots.

As shown in FIG. 6, when the outer cap 200 is constrained from further clockwise rotation due to the abutment of the leg members 214*a*, 214*b* against the arm members 302*a*, 302*b* which are in turn abutted against the abutment portions 114 of the one-way ramp members 110*a*, 110*b*, the lugs 208*a*, 208*b* are aligned above the respective axially extending slots 108*a*, 108*b*. Further, it can be seen from FIG. 6 that the arcuate wall members 216*a*, 216*b* are no longer located above the arm members 302*a*, 302*b* of the intermediate member 300. Thus, in the orientation shown in FIG. 6, the outer cap 200 is able to be axially moved toward the inner cap 100 to move the lugs 208*a*, 208*b* into the axially extending slots 108*a*, 108*b*. Axial movement of the outer cap 200 toward the inner cap 100 produces a corresponding axial compression of the spring 304. Release of the outer cap 200 from a depressed position would cause the outer cap 200 to be biased upwardly away from the inner cap 100 due to the axial expansion of the compressed spring 304.

Figure 7:
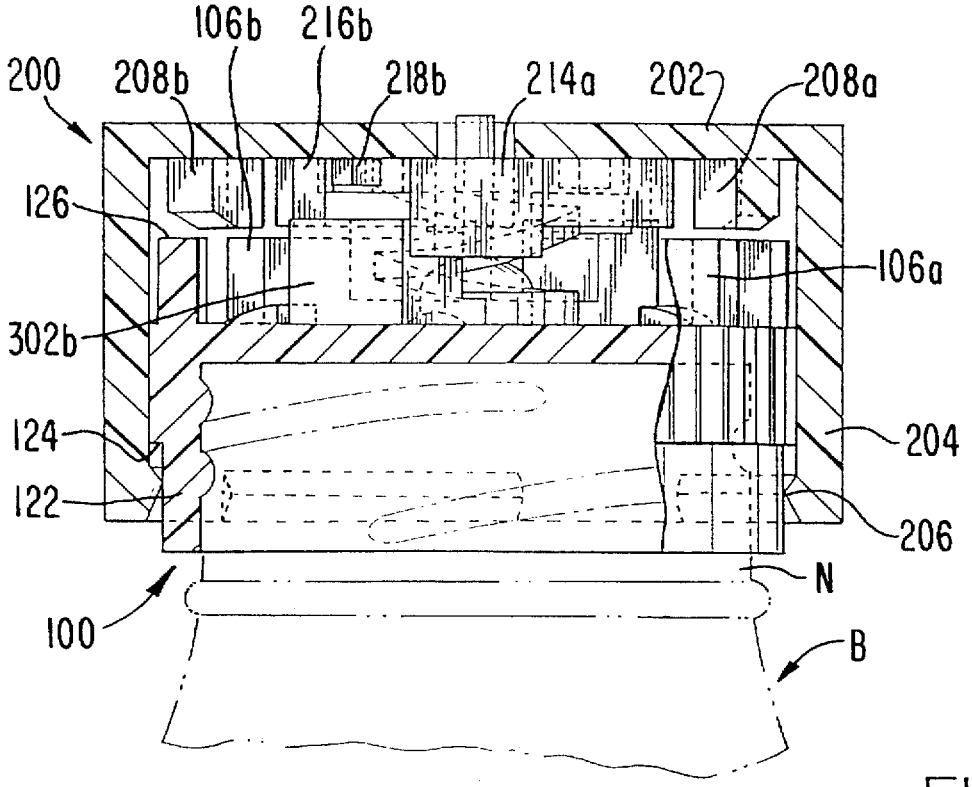
FIG. 7 is a side sectional view taken along line 7—7 of FIG. 6 showing the respective elements prior to the outer cap being axially depressed downwardly.
Figure 8:
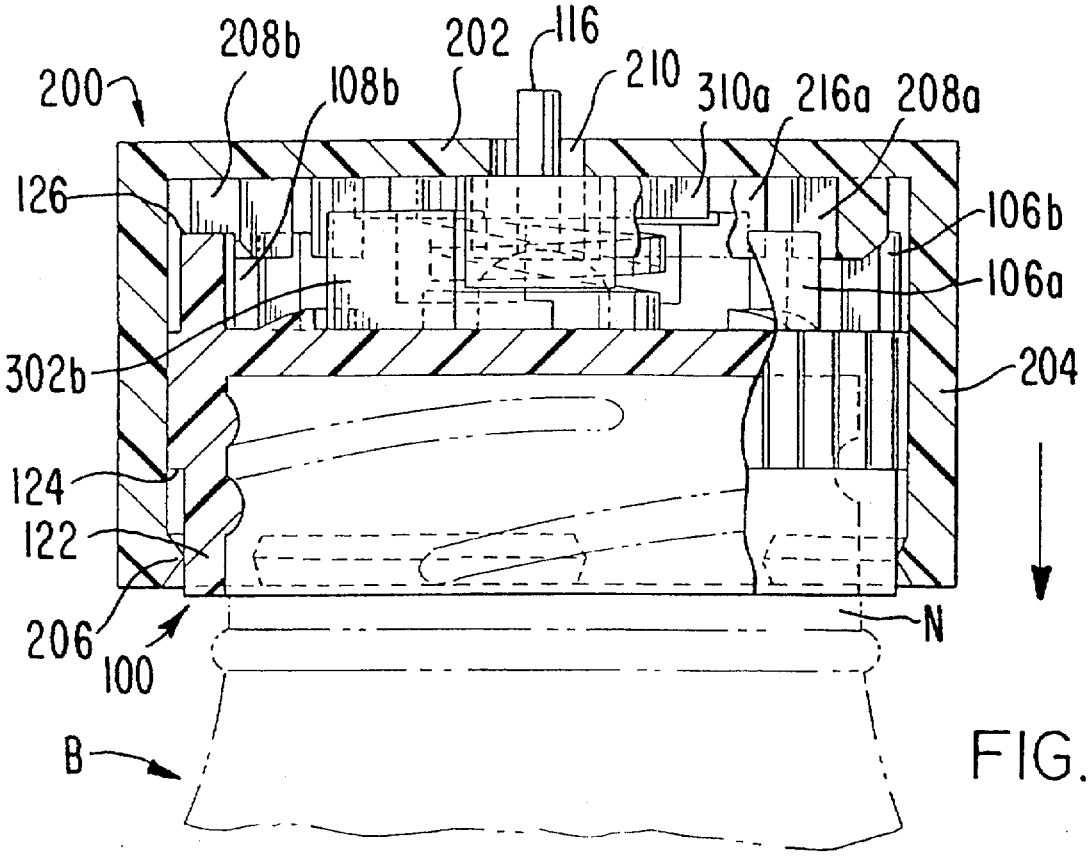
FIG. 8 is a side sectional view taken along line 8—8 in FIG. 6 showing the respective elements after the outer cap has been axially depressed downwardly.

When the outer cap 200 assumes an orientation as shown in FIG. 6, the outer cap 200 may be depressed from a upward position shown in FIG. 7 to a downward position shown in FIG. 8. As shown in FIG. 8, the lugs 208*a*, 208*b* are engaged in the axially extending slots 108*a*, 108*b*. Thus, rotation of the outer cap 200 produces a corresponding rotation of the inner cap 100 to either tighten or loosen the inner cap 100 from the bottle B, depending on whether the outer cap 200 is rotated clockwise or counter-clockwise.

As shown in FIG. 8, the spring 304 is both axially compressed and torsionally rotated. Thus, the spring 304 stores a force which is both axial and torsional, such that when the outer cap 200 is released from the position shown in FIG. 8,the outer cap 200 will move upwardly and rotate counter-clockwise such that the lugs 208*a*, 208*b* are no longer aligned with the axially extending slots 108*a*, 108*b*. Accordingly, the child-resistant closure is returned to a child-resistant mode automatically to provide additional safety.

If the outer cap 200 is rotated counter-clockwise from a position shown in FIG. 6, it is possible that frictional engagement between the inner surface of the top wall 202 of the outer cap against the upper surface of the upper ring member 308 may cause the intermediate member to rotate counter-clockwise with the rotation of the outer cap 200. To deter this, the protrusion 120 arranged on the top wall 104 of the inner cap 100 engages against the arm member 302*a* to inhibit the intermediate member 300 from further rotation due to the aforementioned recited frictional engagement.

The frictional engagement between the inner surface of the top wall 202 of the outer cap 200 against the upper surface of the upper ring member 308 is minimal or non-existent when the closure is the child-resistant mode. Thus, the spring 304 is relieved from axial and torsional compressive loading so that the spring 304 does not lose its memory and will return to its initial position. Only while the inner cap 100 and the outer cap 200 are inter-connected in the non-child-resistant mode is the spring 304 axially and torsionally compressed. Thereafter, when the closure is released by the user, the outer cap 200 is automatically returned to the child-resistant mode and the compressive forces on the spring 304 are automatically released when the outer cap 200 of the closure is released.

As shown in FIG. 8,when the outer cap 200 is axially depressed, the post 116 extends through the aperture 210 in the outer cap 200 to provide a visual indication that the closure is oriented in a non-child-resistant mode.

When the child-resistant closure of the present invention is placed on a bottle, it is not necessary for the closure to be in a non-child-resistant mode. Instead, the closure may be placed on the bottle B while the closure is in either the child-resistant mode or the non-child-resistant mode. This is possible in part because the outer cap 200 is designed such that clockwise, or tightening rotation thereof, will produce a corresponding tightening or clockwise rotation of the inner cap 100 whether or not the closure is in a child-resistant mode. Thus, it is possible to install or remove the closure from the bottle without requiring any squeezing of the outer cap 200 or alignment of arrows and the like. Instead, the outer cap 200 may be gripped in the normal manner using the thumb and forefinger, or may even be rotated by pressing the outer cap 200 into the palm of the user's hand, which is particularly beneficial for people suffering from arthritis and who are not able to produce a firm grip of the outer cap 200.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A child-resistant closure comprising:

an inner cap adapted to be threadably mounted on a container;

an outer cap mounted on said inner cap, said outer cap being freely rotatable in a first direction relative to the inner cap during a child-resistant mode of the closure but directly interconnectable with the inner cap for removal of the closure from the container during a non-child-resistant mode of the closure; and an intermediate member located between said inner cap and said outer cap, said intermediate member being freely rotatable in said first direction between a first position prohibiting the inner and outer caps from being interconnected for removal from the container and a second position permitting the manipulation of the outer cap relative to the inner cap for interconnecting the inner and outer caps for removal of the closure from the container.

2. The child-resistant closure according to claim 1, wherein said outer cap includes a top wall having an aperture therein, and wherein said inner cap includes a top wall having a post extending upwardly therefrom, said post being movable into said aperture such that a portion of said post extends above the top wall of the outer cap when in said non-child-resistant mode.

3. The child-resistant closure according to claim 1, wherein said inner cap includes a skirt portion having a shoulder located on an outer surface thereof, and said outer cap includes a skirt portion having an annular bead located on a inner surface thereof for engaging said shoulder.

4. The child-resistant closure according to claim 1, further comprising a spring integrally formed with said intermediate member and located between said inner cap and said outer cap for axially biasing said outer cap away from said inner cap.

5. The child-resistant closure according to claim 4, wherein said spring torsionally biases said outer cap in said first direction of rotation when the outer cap is released from interconnection with the inner cap to automatically return said closure to the child-resistant mode.

6. A child-resistant closure comprising:

an inner cap adapted to be threadably mounted on a container;

an outer cap mounted on said inner cap, said outer cap being freely rotatable in a first direction relative to the inner cap during a child-resistant mode of the closure but interconnectable with the inner cap for removal of the closure from the container during a non-child-resistant mode of the closure; and an intermediate member located between said inner cap and said outer cap, said intermediate member being freely rotatable in said first direction between a first position prohibiting the inner and outer caps from being interconnected for removal from the container and a second position permitting the manipulation of the outer cap relative to the inner cap for interconnecting the inner and outer caps for removal of the closure from the container, wherein said outer cap includes a top wall having an inner surface, said inner surface including at least one lug member extending therefrom, said inner cap including a raised arcuate wall member having an axially extending slot therein, said lug being movable into said slot when said closure is in said non-child-resistant mode.

7. The child-resistant closure according to claim 6, wherein said lug rides along an upper peripheral surface of said raised arcuate wall member while in said child-resistant mode.

8. A child-resistant closure comprising:

an inner cap adapted to be threadably mounted on a container;

an outer cap mounted on said inner cap, said outer cap being freely rotatable in a first direction relative to the inner cap during a child-resistant mode of the closure but interconnectable with the inner cap for removal of the closure from the container during a non-child-resistant mode of the closure; and an intermediate member located between said inner cap and said outer cap, said intermediate member being freely rotatable in said first direction between a first position prohibiting the inner and outer caps from being interconnected for removal from the container and a second position permitting the manipulation of the outer cap relative to the inner cap for interconnecting the inner and outer caps for removal of the closure from the container, wherein said inner cap includes a top wall having at least one ramp member located thereon, said ramp member permitting said intermediate member to rotate in said first direction while stopping rotation of said intermediate member in a second direction opposite to the first direction.

9. A child-resistant closure comprising:

an inner cap adapted to be threadably mounted on a container;

an outer cap mounted on said inner cap, said outer cap being freely rotatable in a first direction relative to the inner cap during a child-resistant mode of the closure but interconnectable with the inner cap for removal of the closure from the container during a non-child-resistant mode of the closure; and an intermediate member located between said inner cap and said outer cap, said intermediate member being freely rotatable in said first direction between a first position prohibiting the inner and outer caps from being interconnected for removal from the container and a second position permitting the manipulation of the outer cap relative to the inner cap for interconnecting the inner and outer caps for removal of the closure from the container, wherein rotation of said outer cap in a second direction opposite to the first direction while in said child-resistant mode further tightens the inner cap on the container.

10. A child-resistant closure comprising:

an inner cap adapted to be threadably mounted on a container;

an outer cap mounted on said inner cap, said outer cap being freely rotatable in a first direction relative to the inner cap during a child-resistant mode of the closure but interconnectable with the inner cap for removal of the closure from the container during a non-child-resistant mode of the closure; and an intermediate member located between said inner cap and said outer cap, said intermediate member being freely rotatable in said first direction between a first position prohibiting the inner and outer caps from being interconnected for removal from the container and a second position permitting the manipulation of the outer cap relative to the inner cap for interconnecting the inner and outer caps for removal of the closure from the container, wherein said outer cap includes a top wall having an inner surface with at least one stop member extending therefrom, said intermediate member comprises at least one arm member and a spring, said spring having a first end connected to said arm member, said spring further having a second end including at least one ear member, said inner cap including at least one abutment member engagable by said arm member for limiting rotation of said arm member past said abutment member in a second direction opposite to the first direction to thereby limit rotation of said first end of said spring in said second direction, said ear member being engagable by said stop member when said outer cap is rotated in said second direction for torsionally rotating said second end of said spring to produce a torsional biasing force which biases said outer cap in said first direction of rotation to automatically return said closure to the child-resistant mode when said outer cap is released.

11. A child-resistant closure comprising:

an inner cap adapted to be threadably mounted on a container;

an outer cap mounted on said inner cap, said inner cap being rotatable in a first direction of rotation relative to the inner cap during a child-resistant mode of the closure but interconnectable with the inner cap for removal of the closure from the container during a non-child-resistant mode of the closure; and an intermediate member located between said inner cap and said outer cap, said intermediate member being freely rotatable between a first position prohibiting the inner and outer caps from being interconnected for removal from the container and a second position permitting the manipulation of the outer cap relative to the inner cap for interconnecting the inner and outer caps for removal of the closure from the container, said intermediate member including a biasing member for biasing said outer cap in said first direction of rotation when the outer cap is released from interconnecting with the inner cap to place said closure in the child-resistant mode.

12. The child-resistant closure according to claim 11, wherein said inner cap includes a top wall having at least one ramp member located thereon, said ramp member permitting said intermediate member to rotate in said first direction while stopping rotation of said intermediate member, in a second direction opposite to the first direction.

13. The child-resistant closure according to claim 11, wherein rotation of said outer cap in a second direction opposite to the first direction while in said child-resistant mode further tightens the inner cap on the container.

14. The child-resistant closure according to claim 11, wherein said biasing member is a spring integrally formed with said intermediate member and located between said inner cap and said outer cap for axially biasing said outer cap away from said inner cap.

15. The child-resistant closure according to claim 11, wherein said outer cap includes a top wall having an aperture therein, and wherein said inner cap includes a top wall having a post extending upwardly therefrom, said post being movable into said aperture such that a portion of said post extends above the top wall of the outer cap when in said non-child-resistant mode.

16. The child-resistant closure according to claim 11, wherein said inner cap includes a skirt portion having a shoulder located on an outer surface thereof, and said outer cap includes a skirt portion having an annular bead located on a inner surface thereof for engaging said shoulder.

17. The child-resistant closure according to claim 11, wherein said outer cap includes a top wall having an inner surface with at least one stop member extending therefrom, said intermediate member comprises at least one arm member and said biasing member includes a spring, said spring having a first end connected to said arm member, said spring further having a second end including at least one ear member, said inner cap including at least one abutment member engagable by said arm member for limiting rotation of said arm member past said abutment member in a second direction opposite to the first direction to thereby limit rotation of said first end of said spring in said second direction, said ear member being engagable by said stop member when said outer cap is rotated in said second direction for torsionally rotating said second end of said spring to produce a torsional biasing force which biases said outer cap in said first direction of rotation to automatically return said closure to the child-resistant mode when said outer cap is released.

18. The child-resistant closure according to claim 11, wherein said outer cap is directly interconnectable with the inner cap for removal of the closure from the container during the non-child-resistant mode of the closure.

19. The child-resistant closure according to claim 11 wherein said outer cap includes a top wall having an inner surface, said inner surface including at least one lug member extending therefrom, said inner cap including a raised arcuate wall member having an axially extending slot therein, said lug being movable into said slot when said closure is in said non-child-resistant mode.

20. The child-resistant closure according to claim 19, wherein said lug rides along an upper peripheral surface of said raised arcuate wall member while in said child-resistant mode.

21. A child-resistant closure comprising:

an inner cap adapted to be threadably mounted on a container;

an outer cap mounted on said inner cap, said outer cap being rotatable in a first direction of rotation relative to the inner cap during a child-resistant mode of the closure, and rotatable in a second direction of rotation opposite to said first direction and interconnectable with the inner cap for removal of the closure from the container during a non-child-resistant mode of the closure;

an intermediate member located between said inner cap and said outer cap, said intermediate member being freely rotatable between a first position prohibiting the inner and outer caps from being interconnected for removal from the container and a second position permitting the manipulation of the outer cap relative to the inner cap for interconnecting the inner and outer caps for removal of the closure from the container; and engagable members located between said intermediate member and said inner and outer caps, said engagable members providing a rotative biasing force biasing said outer cap in said first direction of rotation as said outer cap is rotated in said second direction of rotation to the position where the outer cap is interconnectable with the inner cap during the non-child-resistant mode of the closure, whereby upon release of the closure, the outer cap is automatically rotatively biased in said first direction of rotation placing said closure in the child-resistant mode.

22. The child-resistant closure according to claim 21, further including means located on said inner cap in a path of movement of said intermediate member for retarding rotative movement of said intermediate member.

23. A child-resistant closure comprising:

an inner cap adapted to be threadably mounted on a container, said inner cap including a top wall having at least one ramp member located thereon, said ramp member including an abutment portion, said inner cap further including a raised arcuate wall member having an axially extending slot therein;, an outer cap mounted on said inner cap, said outer cap including a top wall having an inner surface with at least one stop member and at least one lug member extending therefrom, said outer cap being freely rotatable in a first direction relative to the inner cap during a child-resistant mode of the closure but interconnectable with the inner cap for removal of the closure from the container during a non-child-resistant mode of the closure;

an intermediate member located between said inner cap and said outer cap, said intermediate member including at least one arm member, said ramp member permitting said intermediate member to rotate in said first direction, said abutment portion limiting rotation of said intermediate member in a second direction opposite to the first direction, said intermediate member being freely rotatable in said first direction between a first position prohibiting the inner and outer caps from being interconnected for removal from the container as said lug rides along an upper peripheral surface of said raised arcuate wall member, and a second position permitting the manipulation of the outer cap relative to the inner cap for interconnecting the inner and outer caps by moving said lug into said slot for removal of the closure from the container; and a spring integrally formed with said intermediate member and located between said inner cap and said outer cap for axially biasing said outer cap away from said inner cap, said spring having a first and connected to said arm member, said spring further having a second end including at least one ear member, wherein said abutment portion is engagable by said arm member for limiting rotation of said arm member past said abutment portion in said second direction to thereby limit rotation of said first end of said spring in said second direction, said ear member being engagable by said stop member when said outer cap is rotated in said second direction for torsionally rotating said second end of said spring to produce a torsional biasing force which biases said outer cap in said first direction of rotation to automatically return said closure to the child-resistant mode when said outer cap is released.

* * * * *